US005243791A

United States Patent [19]

Funke

[11] Patent Number: 5,243,791

[45] Date of Patent: Sep. 14, 1993

[54] POLISHING FIXTURE AND METHOD FOR POLISHING LIGHT EMITTING DEVICES

[75] Inventor: Klaus E. Funke, San Rafael, Calif.

[73] Assignee: AMP Incorporated, Harrisburg, Pa.

[21] Appl. No.: 617,447

[22] Filed: Nov. 26, 1990

Related U.S. Application Data

[63] Continuation of Ser. No. 342,924, Apr. 25, 1989, abandoned.

[51] Int. Cl.[5] ..... B24B 7/00

[52] U.S. Cl. ..... 51/217 R; 51/216 LP

[58] Field of Search ..... 51/283 R, 277, 217 R, 51/217 P, 217 LP, 217 S, 281 R, 131.3, 216 R, 216 T; 269/40, 287

[56] References Cited

U.S. PATENT DOCUMENTS

| | | | |
|---|---|---|---|
| 53,218 | 3/1886 | Elliott | 51/131.3 |
| 125,565 | 4/1872 | Haines | 51/217 R |
| 2,779,139 | 1/1957 | Boettcher | 51/216 T |
| 3,284,961 | 11/1966 | Graves | 51/170 |
| 3,868,794 | 3/1975 | Zitkus | 51/283 |
| 3,892,092 | 7/1975 | Keith, Jr. | 51/154 |
| 3,906,678 | 9/1975 | Roth | 51/154 |
| 4,272,926 | 6/1981 | Tamulevich | 51/131.2 |
| 4,512,113 | 4/1985 | Budinger | 51/236 |
| 4,534,536 | 8/1985 | Nelson et al. | 249/83 |
| 4,539,776 | 9/1985 | Weaver, Jr. | 51/156 |
| 4,587,768 | 5/1986 | Doyle | 51/124 R |
| 4,623,500 | 11/1986 | Nelson et al. | 264/162 |
| 4,648,688 | 3/1987 | Ashman et al. | 350/96.20 |
| 4,666,241 | 5/1987 | Caron | 350/96.21 |
| 4,693,035 | 9/1987 | Doyle | 51/277 |
| 4,707,948 | 11/1987 | Schindler | 51/216 R |
| 4,773,725 | 9/1988 | Ashman et al. | 350/96.20 |
| 4,819,386 | 4/1989 | Struyf | 51/217 |

FOREIGN PATENT DOCUMENTS

| | | | |
|---|---|---|---|
| 0161256 | 9/1984 | Japan | 51/283 R |
| 0283854 | 11/1988 | Japan | 51/157 |

*Primary Examiner*—Robert A. Rose

[57] ABSTRACT

A polishing fixture (10) and method of using the polishing fixture are disclosed. The polishing fixture (10) comprises a first and second clamping member (12, 14) for releasably securing therebetween a plurality of light emitting devices (30, 32, 34). The leads of the devices (30, 32, 34) pass through one of the clamping members (12), with a forward end (50) of the devices (30, 32, 34) passing through apertures in the other clamping member (14). The clamping members (12, 14) are releasably secured together (16, 18), securing the devices (30, 32, 34) therebetween with a forward end surface (70) of each of the devices (30, 32, 34) spaced from an outside surface (38) of a clamping member (14) for polishing.

4 Claims, 3 Drawing Sheets

POLISHING FIXTURE AND METHOD FOR POLISHING LIGHT EMITTING DEVICES

This application is a continuation of application Ser. No. 07/342,924 filed Apr. 25, 1989, now abandoned.

BACKGROUND OF THE INVENTION

This invention relates to polishing light emitting devices and, in particular, to a polishing fixture and method for simultaneously polishing the surfaces of the front ends of a plurality of light emitting devices.

Light emitted from a light emitting device (LED) that is carried by an optical fiber to a light sensing device is channeled into an end of the optical fiber. One known technique positions a lens between the light emitting device and an end of the optical fiber to focus the light so that a majority of the light will enter the end of the optical fiber. An alternative technique requires positioning the end of the optical fiber as closely as possible to the emitting diode of the light emitting device to maximize the amount of light emitted by the light emitting device that enters the end of the optical fiber.

The use of a lens to focus the light of a light emitting device is relatively expensive when compared to positioning the fiber close to the emitting device of a light emitting device. It would be desirable to have a fixture and method of using the fixture for polishing a forward facing surface of light emitting devices for enabling the positioning of an optical fiber as closely as possible to the emitting device of the light emitting device.

SUMMARY OF THE INVENTION

In accordance with the present invention, a polishing fixture for simultaneously polishing the forward surfaces of the respective front ends of a plurality of light emitting devices includes a first clamping member having recess means for receiving therethrough the electrical leads of each of the plurality of light emitting devices. A second clamping member has apertures for receiving the front end of each of the plurality of light emitting devices. The forward facing surface of the front end of each of the plurality of light emitting devices is passed through an aperture in the second clamping member and spaced outwardly from a flat outer surface of the second clamping member for polishing. Releasable securing means are provided for releasably securing the first and second clamping members together and for securing each of the plurality of light emitting devices therebetween.

A method of polishing the forward ends of a plurality of light emitting devices simultaneously is disclosed, including the steps of positioning the leads of the devices in apertures in a first clamping member, positioning a second clamping member over the forward ends of the plurality of LED's with the forward ends extending through apertures therein, releasably securing the two clamping members together, with the light emitting devices secured therebetween, and polishing the forward ends of the plurality of light emitting devices simultaneously against a common planar surface of a polishing medium.

DESCRIPTION OF THE PREFERRED EMBODIMENT

Figure 1:
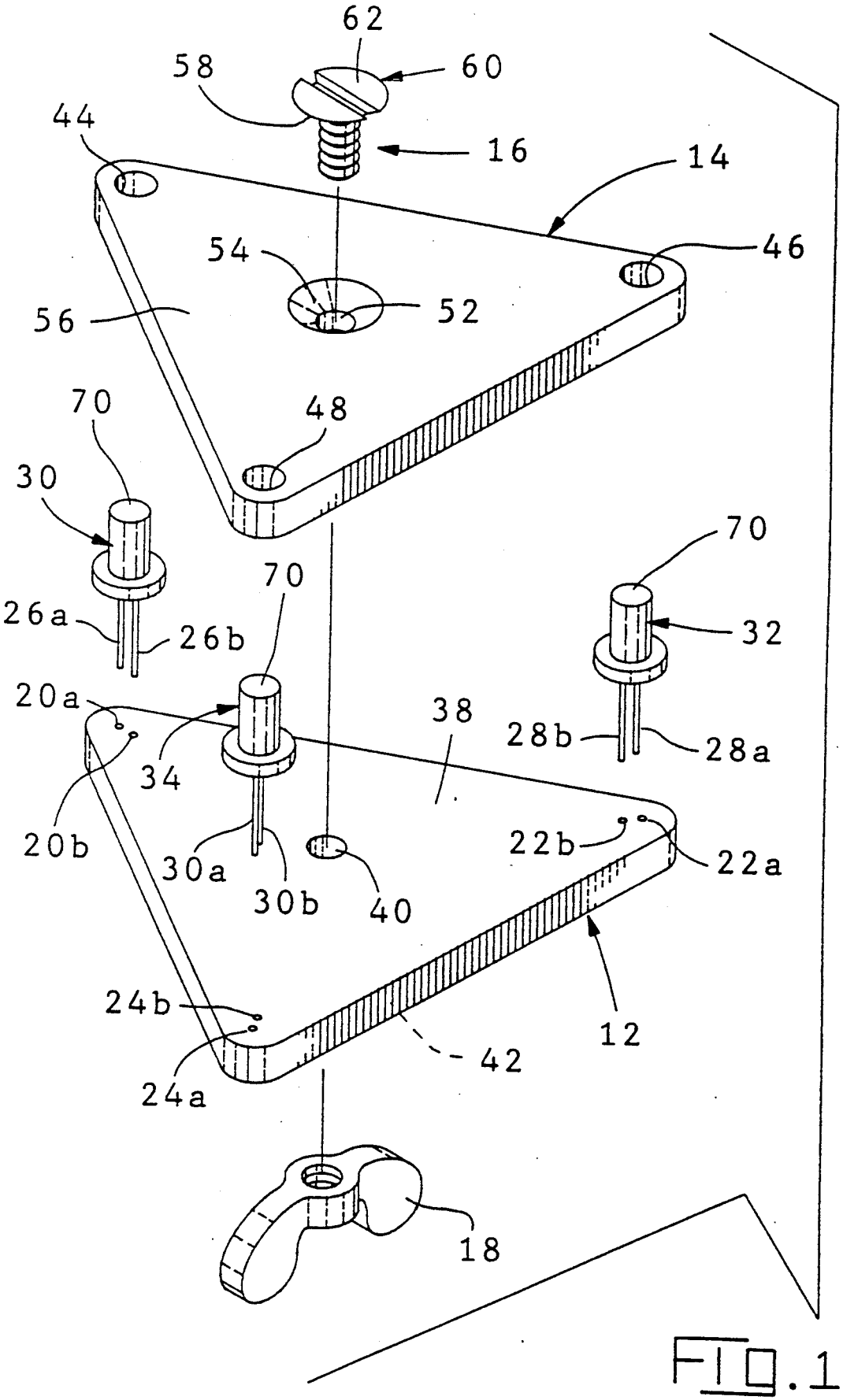
FIG. 1 is an exploded perspective view of the polishing fixture in accordance with the present invention.

A polishing fixture 10 in accordance with the present invention is shown in an exploded perspective view in FIG. 1. Polishing fixture 10 comprises first clamping member 12, second clamping member 14, bolt 16 and wiring nut 18. First clamping member 12 has apertures *20a*, *20b*, *22a*, *22b*, *24a* and *24b* to receive electrical leads *26a*, *26b*, *28a*, *28b*, *30a* and *30b* of light emitting devices 32, 34 and 36 respectively, from planar inner surface 38. Aperture 40 in first clamping member 12 is centrally located with respect to apertures 20, 22 and 24 and receives bolt 16. Wing nut 18 is drawn against outer surface 42 as wing nut 18 is threaded onto bolt 16 to secure first and second clamping members 12, 14 together.

Second clamping member 14 has apertures 44, 46 and 48 positioned to receive the light emitting or forward end 50 of LED's 32, 34, 36 when the leads thereof are received in apertures 20, 22, 24. Aperture 52 in second clamping member 14 is centrally located with respect to apertures 44, 46 and 48 and is axially aligned with aperture 40 to receive bolt 16. The periphery 54 of aperture 52 on outer surface 56 of second clamping member 14 is chamfered to receive complementary tapered under surface 58 of head 60 on bolt 16 such that the surface 62 of head 60 mounts flush with surface 56. In this manner, bolt 16 and wing nut 18 provide means for releasably securing first and second clamping members 12, 14 together, as well as means for securing LED's 30, 32 and 34 in polishing fixture 10 between first and second clamping members 12, 14.

Figure 2:
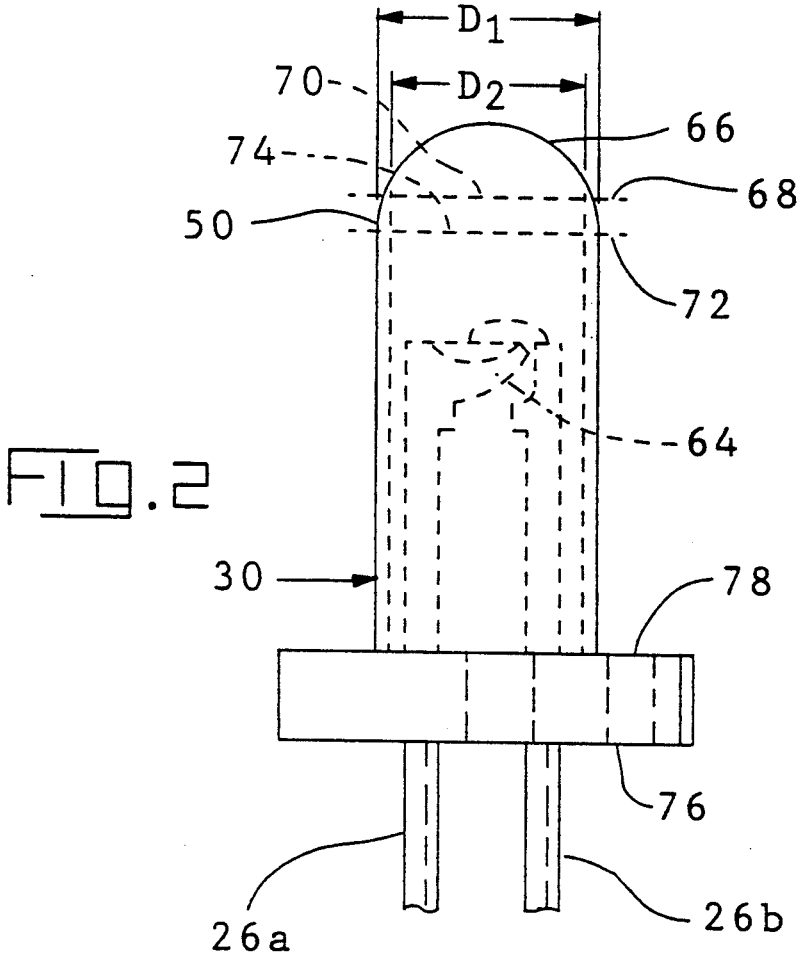
FIG. 2 is a enlarged side view of a light emitting device.
Figure 4:
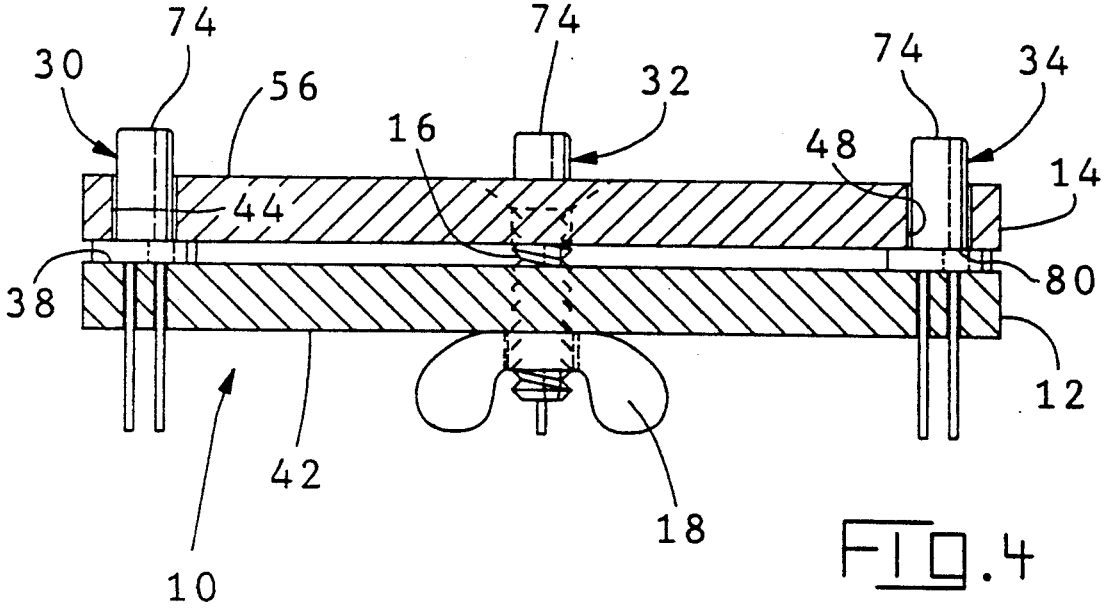
FIG. 4 is a side view of the polishing fixture having light emitting devices securing therein, with the clamping members releasably secured together.

The light emitting device 30 as shown in FIG. 2, is typical of light emitting devices 30, 32, 34, as commercially available. The substrate 64 is encapsulated in a plastic forward end 50 that extends to a hemispherical tip 66. The tip 66 may be removed by machining, sanding or other known process to a position designated by line 68 in FIG. 2 and defining rough forward end surface 70 shown in FIG. 1. Rough surface 70 is spaced forwardly, away from light emitting diode 64, at least a distance equivalent to the reduction in axial length that forward end 50 is to be lessened during the polishing process. The polished forward end surface is designated by line 72 in FIG. 2 and is shown as surface 74 in FIG. 4. Polished forward end surface 74 may be anywhere along forward end 50 that provides a flat surface for emitting light but does not expose substrate 64 to air and is typically within 0.020" of substrate 64.

Light emitting device 30 has a bottom surface 76 through which leads *26a* and *26b* pass and an opposed annular stop shoulder 78, extending radially outwardly beyond forward end 50, which is typically used to depth position forward end 50 of a light emitting device in a panel aperture. In polishing fixture 10, each LED bottom surface 76 engages planar inner surface 38 of first clamping member 12. As second clamping member 14 is positioned over the forward ends of light emitting devices 30, 32, 34, planar inner surface 80 of second clamping member 14 engages stop shoulders 78 on LED's 30, 32, 34. As wing nut 18 is tightened on bolt 16, the diodes are secured in polishing fixture 10, between the first and through a respective aperture in second clamping member 14 such that rough forward end surfaces 70 are spaced and maintained outwardly from surface 56 for polishing. Rough forward end surfaces 70 are cleaned to remove particulate material remaining subsequent to the machining or sanding operation, then spaced outwardly from flat outer surface 56 of second clamping member 14, positioned for polishing.

Figure 3:
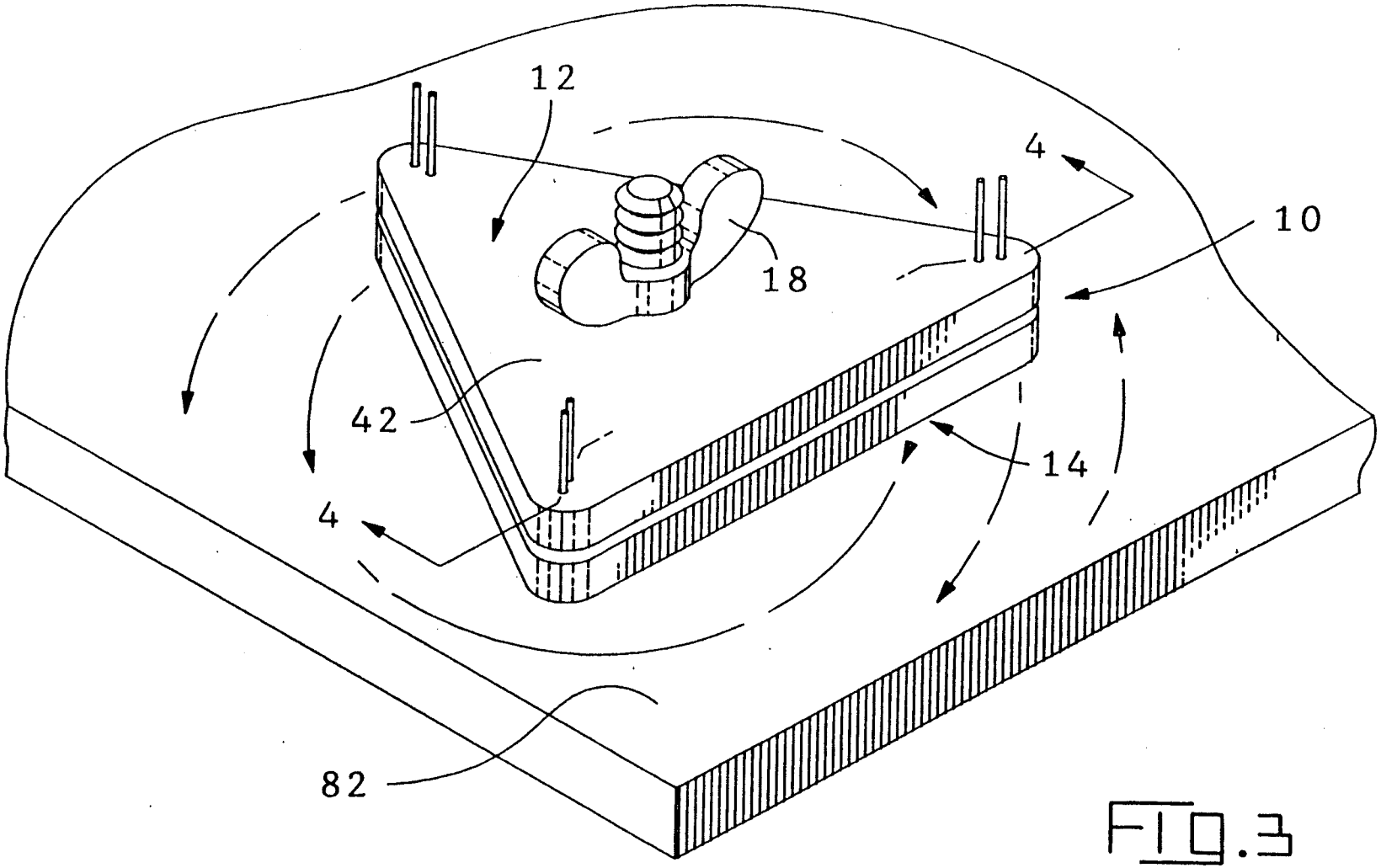
FIG. 3 is a perspective view showing polishing of a forward surface of each of the light emitting devices secured in the polishing fixture.

Rough forward end surfaces 70 are subjected to a polishing action by moving polishing fixture 10, typically in a figure-8 configuration, over a polishing film 82 of fine silicon carbide or aluminum oxide grit as shown in FIG. 3 for a period of time. Multiple stages of polishing may be employed with progressively finer grit. Wet or dry polishing as are known may be employed. Polishing film 82 forms a planar surface. The word "polishing" is used here to mean that the forward end surface of the LED is subjected to further abrasive action. While the axis of any one or all of the light emitting devices 30, 32, 34 secured in polishing fixture 10 may not be precisely normal to a surface of first or second clamping members 12, 14, or one or more of the devices may be eroded away during the polishing process more than the others, either alternative of which would cause polished forward end surfaces 74 of the light emitting devices, although flat, not to be precisely normal to the axis of the device it forms a part of, this is not critical. As long as the polished forward end surface 74 is flat and smooth, an optical fiber can be positioned close to the light emitting substrate 64 for efficient emission of light into the fiber.

Polishing fixture 10 can be made of any suitable material with any suitable releasable securing means to releasably secure the clamping members together. In a preferred embodiment, clamping members 12, 14 are made of stock aluminum plate material approximately ¼" thick, with appropriately sized and positioned apertures for the pairs of leads and the forward ends of the devices.

In a preferred embodiment, polishing fixture 10 secures three light emitting devices therein for polishing. Since three points determine a plane, it is assured that all three LED's in the polishing fixture will be subjected to abrasion and be polished simultaneously, with the advantage that when the polishing process is completed, there is no need to check each of the devices to make sure that the rough forward end surface 70 of each of the devices was polished, especially where the three rough surfaces 70 could forseeably not be in a common plane.

Polishing fixture 10 is used by positioning the leads of a plurality of light emitting devices in apertures in first clamping member 12, then positioning the second clamping member over the forward end of each device with rough forward end surfaces 70 passing through respective apertures in the second clamping member 14 such that the rough forward end surface of each LED is spaced from an outer surface of the second clamping member. Alternatively, the devices may be initially positioned with the forward end of each LED extending through a respective aperture in the second clamping member 12 and subsequently, the first clamping member positioned over the leads, receiving the pairs of leads in respective pairs of apertures in the first clamping member. The two clamping members are releasably secured together, securing the light emitting devices therebetween. The next step includes simultaneously polishing the rough forward end surface of a plurality of LED's. Subsequently, the clamping members are released from the polishing fixture, and thence removed from the clamping members.

Should the diameter $D_1$ (FIG. 2) of the light emitting device, as manufactured, be larger than desired, the diameter can be reduced to a smaller diameter $D_2$ by any known method. The reduction in diameter would typically precede the polishing operation.

I claim:

1. A polishing fixture for simultaneously polishing a surface of the front end of each of a plurality of light emitting devices, comprising:

a first clamping member, said first clamping member having recess means adapted for receiving electrical leads of each of said plurality of light emitting devices;

a second clamping member, said second clamping member having aperture means adapted for receiving the front end of each said plurality of light emitting devices, said surface of the front end of each of said plurality of light emitting devices spaced from an outer surface of said second clamping member for polishing when said light emitting devices are received in said aperture means; where said first clamping member has a pair of apertures in registration with each of said aperture means for receipt of the leads of said light emitting devices, and;

means for releasably securing said first and second clamping members together and for securing each of said plurality of light emitting devices therein, whereby light emitting devices having leads received in the first clamping member with the second clamping member received over the front ends, have a surface spaced from the outer surface of the second clamping member positioned for polishing.

2. A polishing fixture as recited in claim 1 wherein the recess means for receiving the electrical leads comprises apertures through the first clamping member.

3. A polishing fixture as recited in claim 1 wherein the releasable securing means is centrally located relative to the plurality of devices.

4. A polishing fixture as recited in claim 3 wherein the releasable securing means comprises a bolt and nut.

* * * * *